US006074160A

United States Patent [19]

Brumbaugh et al.

[11] Patent Number: 6,074,160

[45] Date of Patent: Jun. 13, 2000

[54] GRAPPLE FOR LOADER BUCKET

[76] Inventors: Eugene L. Brumbaugh; Henry Schulte, both of R.R. 2 Box 111, Gregory, S. Dak. 57533

[21] Appl. No.: 09/311,408

[22] Filed: May 13, 1999

[51] Int. Cl.[7] ..... B66F 9/18

[52] U.S. Cl. ..... 414/704; 414/724; 37/903

[58] Field of Search ..... 414/685, 704, 414/724; 37/903

[56] References Cited

U.S. PATENT DOCUMENTS

| | | | |
|---|---|---|---|
| D. 332,271 | 1/1993 | DuBose et al. . | |
| 2,979,215 | 4/1961 | Brisson . | |
| 3,595,416 | 7/1971 | Perrottl . | |
| 3,700,131 | 10/1972 | Westendorf | 414/704 |
| 4,297,073 | 10/1981 | Schmid et al. | 414/704 |
| 4,372,063 | 2/1983 | Work . | |
| 4,411,573 | 10/1983 | Townshend | 414/704 |
| 5,071,311 | 12/1991 | Foster et al. . | |
| 5,114,299 | 5/1992 | Roche et al. . | |
| 5,564,885 | 10/1996 | Staben, Jr. . | |
| 5,564,886 | 10/1996 | Emerson et al. . | |
| 5,639,205 | 6/1997 | Kaczmarczyk et al. . | |
| 5,797,461 | 8/1998 | Noble . | |

*Primary Examiner*—Gregory A. Morse
*Attorney, Agent, or Firm*—Kaardal & Associates, P.C

[57] ABSTRACT

A grapple for attaching to a loader bucket. The grapple includes a pair of spaced apart elongate mounting arms each being positioned between a pair of mounting flaps extending from a rear of a bucket of a loader and detachably coupled to the mounting flaps. A pair of pivot arms are pivotally coupled to outer ends of the mounting arms. Each of the pivot arms has a bend defining inner and outer portions of the pivot arm. A toothed portion is coupled to outer ends of the pivot arms. The mounting arms, pivot arms and toothed portion are balanced such that the mounting arms are positioned generally horizontally and spaced apart from a ground surface when outer portions of the pivot arms rest on the ground surface and inner portions of the pivot arms are oriented generally perpendicular to the mounting arms.

19 Claims, 3 Drawing Sheets

GRAPPLE FOR LOADER BUCKET

BACKGROUND OF THE INVENTION

1. Field of the Invention

The present invention relates to loader attachments and more particularly pertains to a new grapple for attaching to a loader bucket.

2. Description of the Prior Art

The use of loader attachments is known in the prior art. More specifically, loader attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,979,215; U.S. Pat. No. 5,564,885; U.S. Pat. No. 5,639,205; U.S. Pat. No. 5,797,461; U.S. Pat. No. 5,071,311; U.S. Pat. No. 5,114,299; U.S. Pat. No. 5,564,886; U.S. Pat. No. 4,372,063; U.S. Pat. No. 3,595,416; and U.S. Pat. No. Des. 332,271.

While these devices fulfill their respective, particular objectives and requirements, the aforementioned patents do not disclose a new grapple. The inventive device includes a pair of spaced apart elongate mounting arms each being positioned between a pair of mounting flaps extending from a rear of a bucket of a loader and detachably coupled to the mounting flaps. A pair of pivot arms are pivotally coupled to outer ends of the mounting arms. Each of the pivot arms has a bend defining inner and outer portions of the pivot arm. A toothed portion is coupled to outer ends of the pivot arms. The mounting arms, pivot arms and toothed portion are balanced such that the mounting arms are positioned generally horizontally and spaced apart from a ground surface when outer portions of the pivot arms rest on the ground surface and inner portions of the pivot arms are oriented generally perpendicular to the mounting arms.

In these respects, the grapple according to the present invention substantially departs from the conventional concepts and designs of the prior art, and in so doing provides an apparatus primarily developed for the purpose of attaching to a loader bucket.

SUMMARY OF THE INVENTION

In view of the foregoing disadvantages inherent in the known types of loader attachments now present in the prior art, the present invention provides a new grapple construction wherein the same can be utilized for attaching to a loader bucket.

The general purpose of the present invention, which will be described subsequently in greater detail, is to provide a new grapple apparatus and method which has many of the advantages of the loader attachments mentioned heretofore and many novel features that result in a new grapple which is not anticipated, rendered obvious, suggested, or even implied by any of the prior art loader attachments, either alone or in any combination thereof.

To attain this, the present invention generally comprises a pair of spaced apart elongate mounting arms each being positioned between a pair of mounting flaps extending from a rear of a bucket of a loader and detachably coupled to the mounting flaps. A pair of pivot arms are pivotally coupled to outer ends of the mounting arms. Each of the pivot arms has a bend defining inner and outer portions of the pivot arm. A toothed portion is coupled to outer ends of the pivot arms. The mounting arms, pivot arms and toothed portion are balanced such that the mounting arms are positioned generally horizontally and spaced apart from a ground surface when outer portions of the pivot arms rest on the ground surface and inner portions of the pivot arms are oriented generally perpendicular to the mounting arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grapple apparatus and method which has many of the advantages of the loader attachments mentioned heretofore and many novel features that result in a new grapple which is not anticipated, rendered obvious, suggested, or even implied by any of the prior art loader attachments, either alone or in any combination thereof.

It is another object of the present invention to provide a new grapple which may be easily and efficiently manufactured and marketed.

It is a further object of the present invention to provide a new grapple which is of a durable and reliable construction.

An even further object of the present invention is to provide a new grapple which is susceptible of a low cost of manufacture with regard to both materials and labor, and which accordingly is then susceptible of low prices of sale to the consuming public, thereby making such grapple economically available to the buying public.

Still yet another object of the present invention is to provide a new grapple which provides in the apparatuses and methods of the prior art some of the advantages thereof, while simultaneously overcoming some of the disadvantages normally associated therewith.

Still another object of the present invention is to provide a new grapple for attaching to a loader bucket.

Yet another object of the present invention is to provide a new grapple which includes a pair of spaced apart elongate mounting arms each being positioned between a pair of mounting flaps extending from a rear of a bucket of a loader and detachably coupled to the mounting flaps. A pair of pivot arms are pivotally coupled to outer ends of the mounting arms. Each of the pivot arms has a bend defining inner and outer portions of the pivot arm. A toothed portion is coupled to outer ends of the pivot arms. The mounting arms, pivot arms and toothed portion are balanced such that the mounting arms are positioned generally horizontally and spaced apart from a ground surface when outer portions of the pivot arms rest on the ground surface and inner portions of the pivot arms are oriented generally perpendicular to the mounting arms.

Still yet another object of the present invention is to provide a new grapple that quickly attaches and detaches from the loader bucket.

Even still another object of the present invention is to provide a new grapple that may be rested on the ground for much easier attachment and detachment to the loader bucket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
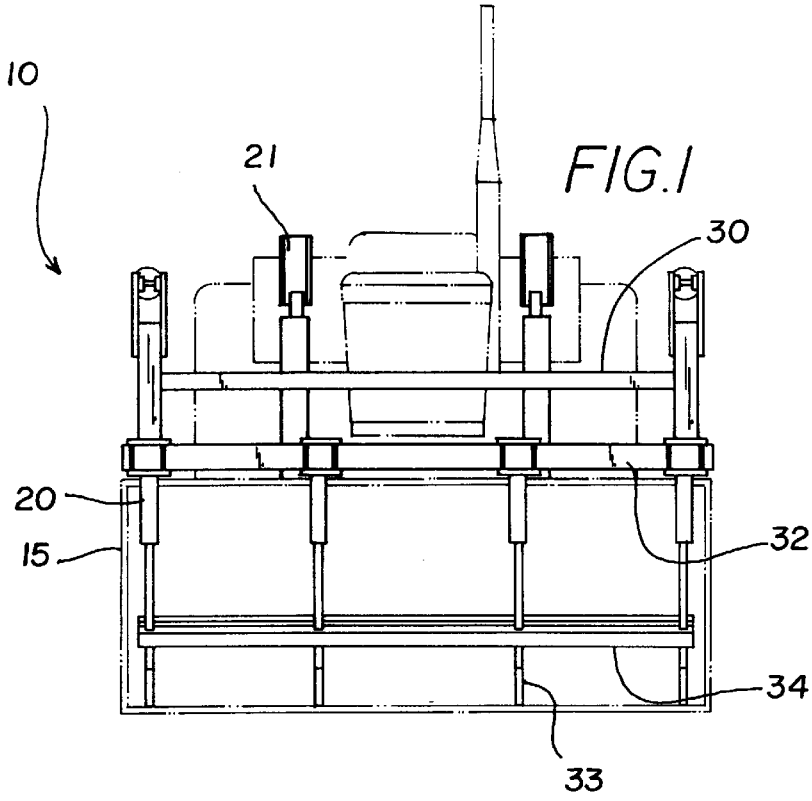
FIG. 1 is a schematic front view of a new grapple according to the present invention.
Figure 2:
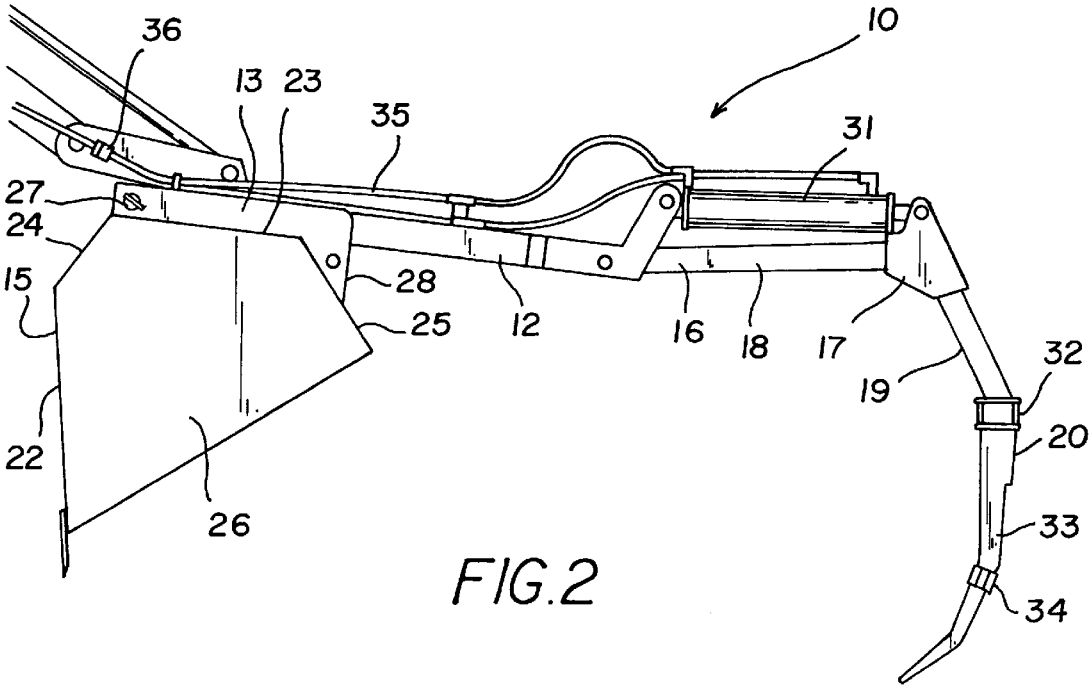
FIG. 2 is a schematic side view of the present invention.
Figure 3:
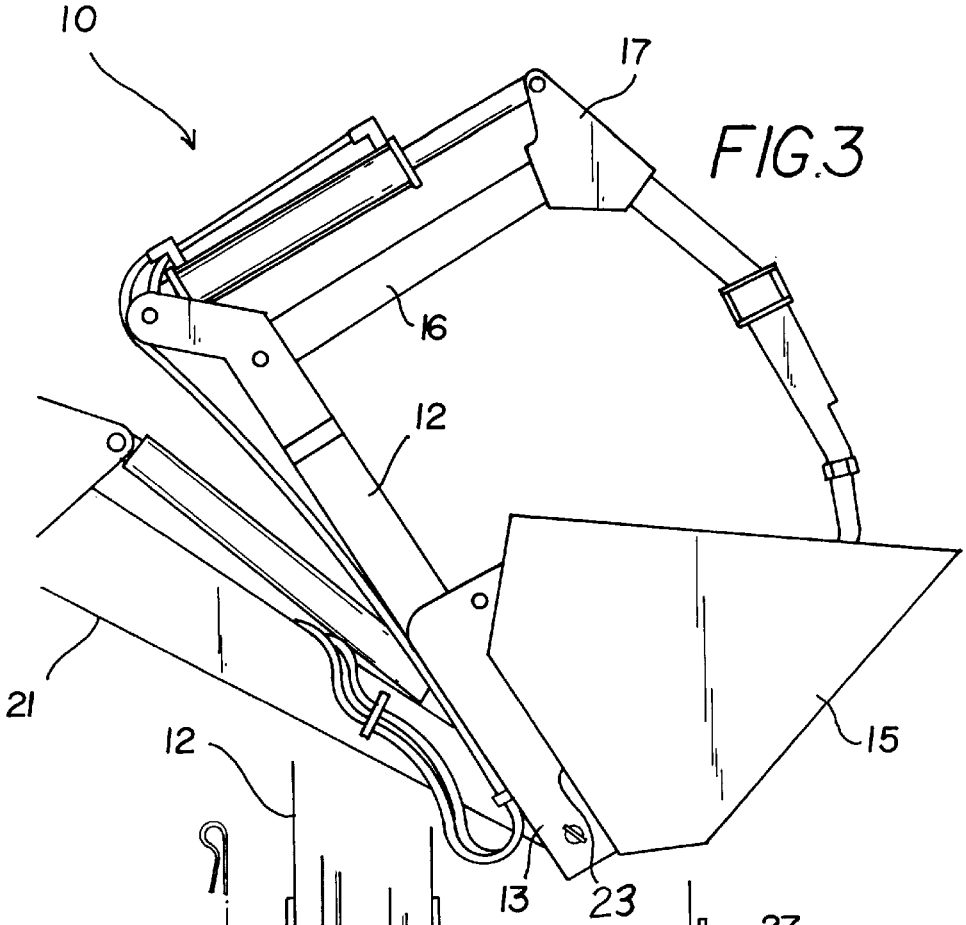
FIG. 3 is a schematic side view of the present invention.
Figure 4:
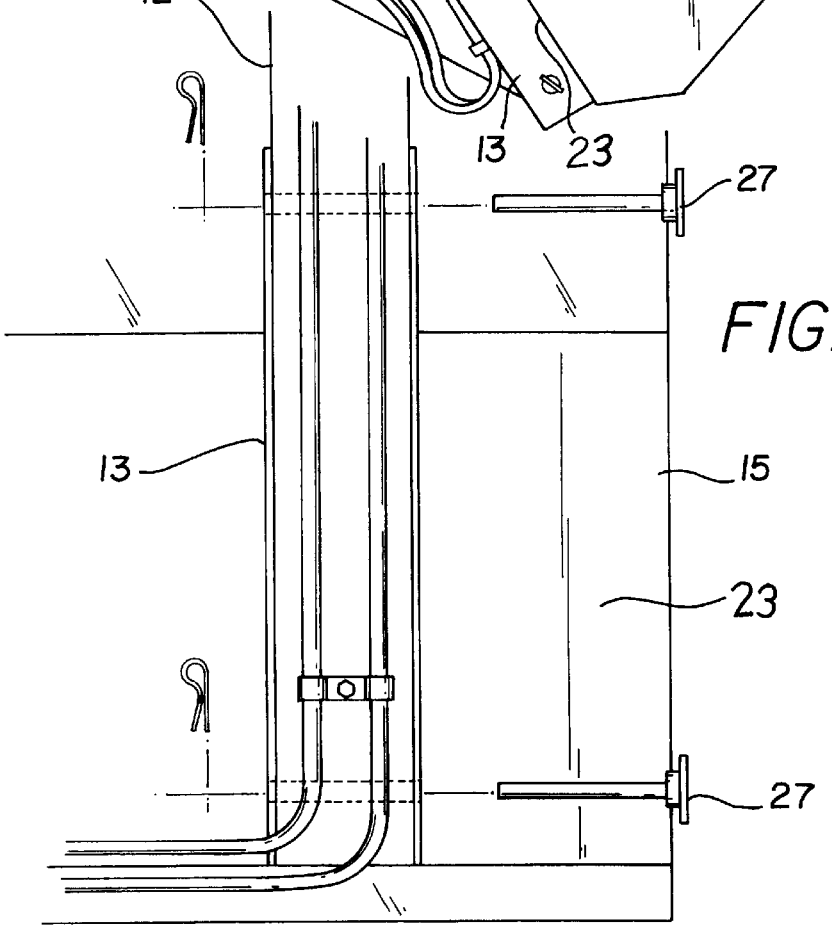
FIG. 4 is a schematic detailed view of the present invention.
Figure 5:
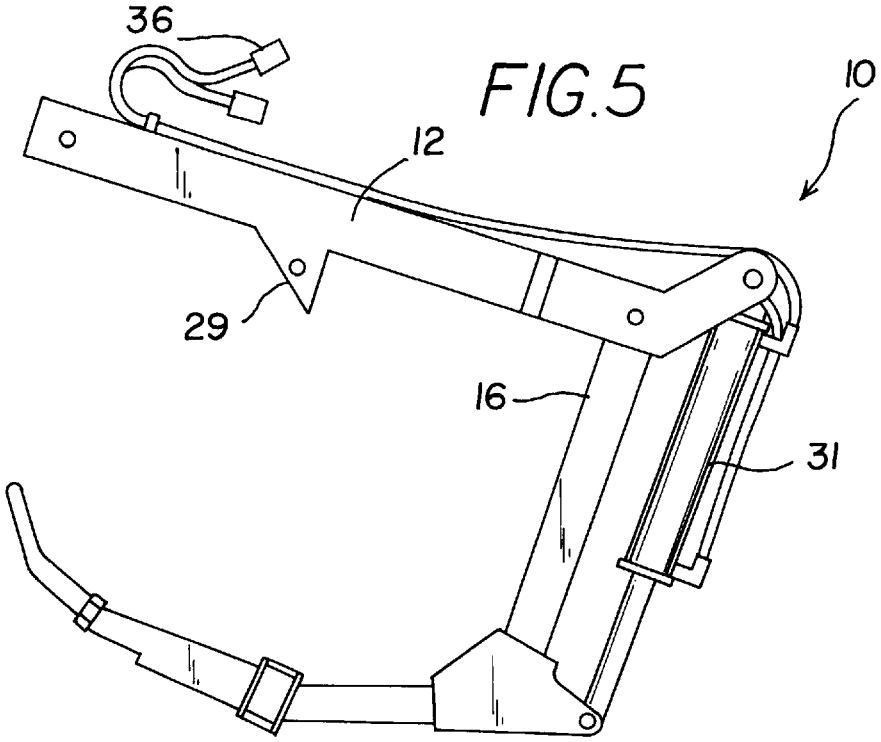
FIG. 5 is a schematic side view of the present invention.

With reference now to the drawings, and in particular to FIGS. 1 through 6 thereof, a new grapple embodying the principles and concepts of the present invention and generally designated by the reference numeral 10 will be described.

As best illustrated in FIGS. 1 through 6, the grapple 10 generally comprises a pair of spaced apart elongate mounting arms 12 each being positioned between a pair of mounting flaps 13 extending from a rear of a bucket 15 of a loader and detachably coupled to the mounting flaps. A pair of pivot arms 16 are pivotally coupled to outer ends of the mounting arms. Each of the pivot arms has a bend 17 defining inner and outer portions 18,19 of the pivot arm. A toothed portion 20 is coupled to outer ends of the pivot arms. The mounting arms, pivot arms and toothed portion are balanced such that the mounting arms are positioned generally horizontally and spaced apart from a ground surface when outer portions of the pivot arms rest on the ground surface and inner portions of the pivot arms are oriented generally perpendicular to the mounting arms.

The grapple is adapted for mounting to a bucket positioned in front or in back of a tractor. A support structure 21 mounts the bucket to the tractor. The support structure is pivotally coupled to the tractor and is pivotally coupled to the bucket. The support structure has a hydraulic system for permitting selective raising, lower, and pivoting of the bucket with respect to the tractor.

Preferably, the bucket has a bottom 22, a back 23, a lower angled portion 24 extending between the bottom and back, an upper portion 25 extending from the back, and a pair of lateral sides 26. Outer edges of the upper portion, bottom, and sides of the bucket define an opening into the bucket.

Two pairs of mounting flaps outwardly extend from the back of the bucket generally parallel the lateral sides of the bucket. Each of the mounting flaps has an aperture through it which is positioned towards the lower angled portion of the bucket through which a pin 27 may be inserted to mount the associated mounting arm to the mounting flaps.

Ideally, each of the mounting flaps has a triangular support portion 28 coupled to the upper portion of the bucket. Each of the triangular support portions has a hole through it through which a pin may be inserted to mount the mounting arms to the mounting flaps.

Preferably, each of the mounting arms of the grapple has a pair of triangular flanges 29 that are positionable along the triangular support portion of the associated mounting flap and which is detachably coupled to the mounting flap by a pin extending through the triangular flanges. The triangular flanges help align holes in the mounting arms and triangular flanges with the holes in the mounting flaps so that the pins may be easily inserted, especially when attempting to mount the grapple to the bucket while driving the tractor. Alternately, the triangular flanges can be replaced by hooks extending from the mounting arms. The hooks are then engageable to pins mounted to the associated mounting flap.

Also preferably, a stabilizer arm 30 extends between the pivot arms to stabilize the grapple.

Preferably, a pair of hydraulic pistons 31 extend between the mounting arms and the bends of the pivot arms for pivoting the pivot arms with respect to the mounting arms. Also preferably, the toothed portion has a cross member 32 extending between the outer ends of the pivot arms and a plurality of teeth 33 extending from the cross member.

The grapple is balanced such that the mounting arms are positioned generally horizontally and spaced apart from a ground surface when outer portions of the pivot arms rest on the ground surface and inner portions of the pivot arms are oriented generally perpendicular to the mounting arms. See FIGS. 5 and 6. The grapple is specifically designed this way so that the grapple will be easy to mount to the bucket.

Ideally, the hydraulic pistons limit pivoting of the mounting arms towards the pivot arms such that the mounting arms are supported at a predetermined angle with respect to the inner portions of the pivot arms when the mounting arms are detached from the bucket. Most ideally, the predetermined angle is substantially perpendicular.

Also ideally, the outer portions of the pivot arms are oriented at an obtuse angle, ideally about 100 degrees, from the inner portions of the pivot arms.

Preferably, a pair of first support bars 34 are coupled to opposite sides of the teeth at upper ends of proximal portions of the teeth.

Figure 6:
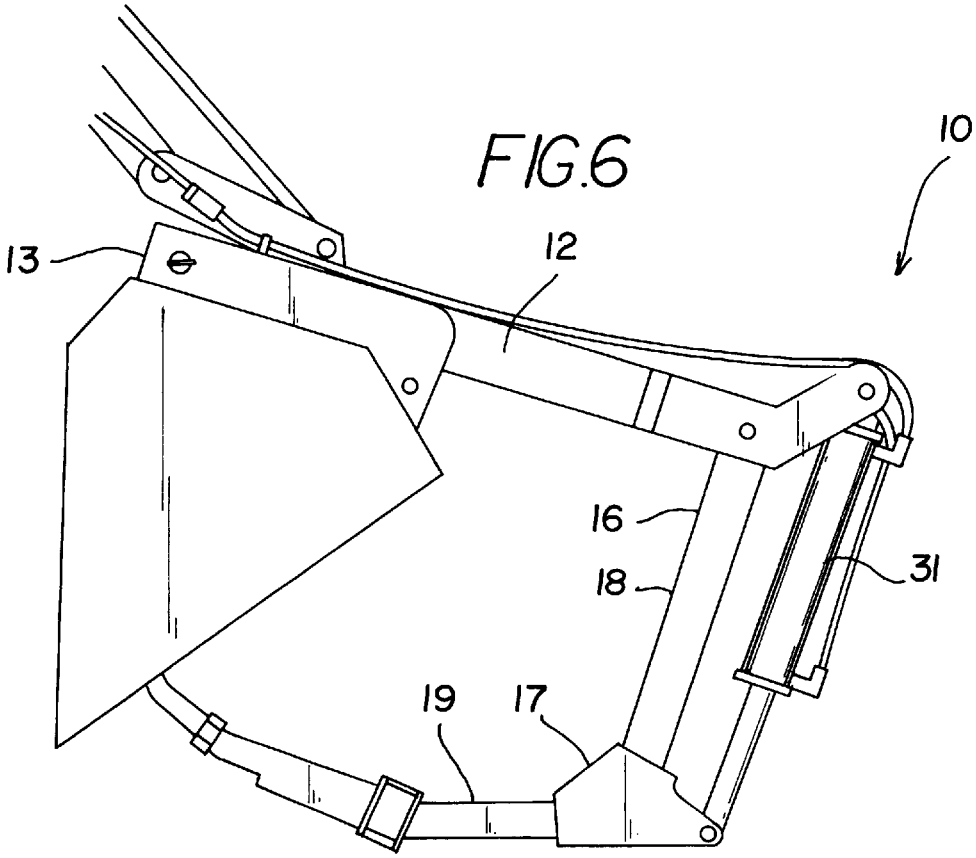
FIG. 6 is a schematic side view of the present invention.

In use, the bucket is positioned such that the mounting arms are positioned between the mounting flaps of the bucket. The pins are inserted through the mounting flaps and mounting arms. The hydraulic lines 35 coupled to the hydraulic pistons are connected to the hydraulic system of the tractor, preferably by quick release couplers 36. The bucket and grapple are used to perform desired tasks. After use, the grapple may be detached by positioning the pivot arms at a generally perpendicular angle to the mounting arms. The outer portions of the pivot arms are rested on a ground surface as shown in FIG. 6 and the pins are removed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A grapple for mounting to a bucket of a loader wherein the bucket has two pairs of mounting flaps outwardly extending from the back of the bucket, the grapple comprising:

a pair of spaced apart elongate mounting arms, each of said mounting arms being positioned between a pair of mounting flaps extending from a rear of a bucket of a loader and detachably coupled to said mounting flaps;

a pair of pivot arms pivotally coupled to outer ends of said mounting arms, each of said pivot arms having a bend defining inner and outer portions of said pivot arm; and a toothed portion coupled to outer ends of said pivot arms;

wherein said mounting arm has a triangular flange for positioning against said bucket adjacent to an opening of the bucket when the mounting arm is mounted to the bucket, said mounting arm having a first end for positioning adjacent to the bucket and a pivot coupling to said pivot arm adjacent to a second end of the mounting arm, said mounting arm having a first length between said first end of the mounting arm and a triangular flange, said mounting arm having a second length between said triangular flange and said pivot coupling, said pivot arm having a third length between said pivot coupling and the bend in said pivot arm, wherein said second length of said mounting arm is approximately equal to said first length of said mounting arm and said second length of the mounting arm is approximately equal to said third length of said pivot arm for maximizing the extension of the pivot arm from said triangular flange and thereby maximizing the grapple reach and the grapple capacity of said toothed portion.

2. The grapple of claim 1, further comprising a pair of hydraulic pistons extending between said mounting arms and said bends of said pivot arms for pivoting said pivot arms with respect to said mounting arms.

3. The grapple of claim 2, wherein said hydraulic pistons limit pivoting of said mounting arms towards said pivot arms such that said mounting arms are supported at a predetermined angle with respect to said inner portions of said pivot arms when said mounting arms are detached from said bucket.

4. The grapple of claim 3, wherein said predetermined angle is substantially perpendicular.

5. The grapple of claim 1, wherein said toothed portion has a cross member extending between said outer ends of said pivot arms and a plurality of teeth extending from said cross member.

6. The grapple of claim 5 wherein the cross member is located approximately half way between end tips of the teeth and the junction of the inner and outer portions of the pivot arms.

7. The grapple of claim 1, wherein said outer portions of said pivot arms are oriented at an obtuse angle from said inner portions of said pivot arms, and wherein said obtuse angle measures approximately 100 degrees.

8. The grapple of claim 1, wherein each of said mounting arms has a pair of triangular flanges for positioning adjacent to a triangular support portion of the associated mounting flap and being detachably mountable to said mounting flap.

9. The grapple of claim 1 wherein the toothed portion includes a plurality of teeth, and wherein one of said plurality of teeth is positioned at each lateral end of the toothed portion such that one of said teeth is positionable adjacent to a lateral side of the bucket when said toothed portion is mounted to the bucket.

10. The grapple of claim 1 additionally comprising a stabilizer arm extending between the pivot arms for stabilizing the pivot arms with respect to each other.

11. The grapple of claim 1 wherein said mounting arms, pivot arms and toothed portion are balanced such that said mounting arms are positioned generally horizontally and spaced apart from a ground surface when outer portions of said pivot arms rest on said ground surface and inner portions of said pivot arms are oriented generally perpendicular to said mounting arms.

12. A loader system for mounting to a tractor, the loader system comprising, in combination:

a bucket positioned in front of a tractor;

a support structure mounting said bucket to said tractor, said support structure being pivotally coupled to said tractor, said support structure being pivotally coupled to said bucket, said support structure having a hydraulic system for permitting selective raising, lower, and pivoting of said bucket with respect to said tractor;

said bucket having a bottom, a back, a lower angled portion extending between said bottom and back, an upper portion extending from said back, and a pair of lateral sides, outer edges of said upper portion, bottom, and sides of said bucket defining an opening into said bucket;

two pairs of mounting flaps outwardly extending from said back of said bucket generally parallel said lateral sides of said bucket, each of said mounting flaps having an aperture therethrough;

each of said mounting flaps having a triangular support portion coupled to said upper portion of said bucket, each of said triangular support portions having a hole therethrough;

a grapple detachably coupled to said mounting flaps of said bucket, said grapple comprising:

a pair of spaced apart elongate mounting arms, each of said mounting arms being positioned between said mounting flaps of a unique pair of mounting flaps of said bucket and detachably coupled to said mounting flaps;

each of said mounting arms having a pair of triangular flanges being positionable along said triangular support portion of the associated mounting flap and being detachable coupled to said mounting flap;

a pair of pivot arms pivotally coupled to outer ends of said mounting arms, each of said pivot arms having an obtuse bend defining inner and outer portions of said pivot arm;

a pair of hydraulic pistons extending between said mounting arms and said bends of said pivot arms for pivoting said pivot arms with respect to said mounting arms; and a toothed portion coupled to outer ends of said pivot arms, said toothed portion having a cross member extending between said outer ends of said pivot arms and a plurality of teeth extending from said cross member;

said grapple being balanced such that said mounting arms are positioned generally horizontally and spaced apart from a ground surface when outer portions of said pivot arms rest on said ground surface and inner portions of said pivot arms are oriented generally perpendicular to said mounting arms;

wherein said hydraulic pistons limit pivoting of said mounting arms towards said pivot arms such that said mounting arms are supported at a predetermined angle with respect to said inner portions of said pivot arms when said mounting arms are detached from said bucket, wherein said predetermined angle is substantially perpendicular;

wherein said outer portions of said pivot arms are oriented at an obtuse angle from said inner portions of said pivot arms.

13. The grapple of claim 12 wherein said mounting arm has a triangular flange for positioning against said bucket adjacent to an opening of the bucket when the mounting arm is mounted to the bucket, said mounting arm has a first end for positioning adjacent to the bucket and a pivot coupling to said pivot arm adjacent to a second end of the mounting arm, said mounting arm having a first length between said first end of the mounting arm and a triangular flange, said mounting arm having a second length between said triangular flange and said pivot coupling, said second length being approximately equal to said first length for increasing the extent of the pivot arm from said triangular flange and increasing the grapple capacity of said toothed portion.

14. The grapple of claim 12 wherein the toothed portion includes a plurality of teeth, and wherein one of said plurality of teeth is positioned at each lateral end of the toothed portion such that one of said teeth is positionable adjacent to a lateral side of the bucket when said toothed portion is mounted to the bucket.

15. The grapple of claim 12 wherein said mounting arm has a triangular flange for positioning against said bucket adjacent to an opening of the bucket when the mounting arm is mounted to the bucket, said mounting arm has a first end for positioning adjacent to the bucket and a pivot coupling to said pivot arm adjacent to a second end of the mounting arm, said mounting arm having a first length between said first end of the mounting arm and a triangular flange, said mounting arm having a second length between said triangular flange and said pivot coupling, said pivot arm having a third length between said pivot coupling and the bend in said pivot arm, wherein the second length of the mounting arm is approximately equal to the third length of said pivot arm for increasing the extent of the pivot arm from said triangular flange and increasing the grapple capacity of said toothed portion.

16. A grapple for removably mounting to a bucket apparatus mounted on a tractor, the bucket apparatus including a bucket and a support structure mounting the bucket to the tractor, the support structure being pivotally coupled to the bucket, the bucket having a bottom, a back, a lower angled portion extending between the bottom and the back, an upper portion extending from the back, and a pair of lateral sides, the support structure including two pairs of mounting flaps outwardly extending from the back of the bucket and generally parallel to the lateral sides of the bucket, each of the mounting flaps having a triangular support portion coupled to the upper portion of the bucket, the grapple comprising:

a pair of spaced apart elongate mounting arms, each of said mounting arms being positionable between the mounting flaps of said bucket and being detachably mountable to said mounting flaps;

each of said mounting arms having a pair of triangular flanges being positionable adjacent to said triangular support portion of the associated mounting flap and being detachably mountable to said mounting flap;

a pair of pivot arms pivotally coupled to outer ends of said mounting arms, each of said pivot arms having an obtuse bend defining inner and outer portions of said pivot arm;

a pair of hydraulic pistons extending between said mounting arms and said bends of said pivot arms for pivoting said pivot arms with respect to said mounting arms; and a toothed portion coupled to outer ends of said pivot arms, said toothed portion having a cross member extending between said outer ends of said pivot arms, a plurality of teeth extending from said cross member;

wherein said hydraulic pistons limit pivoting of said pivot arms towards said mounting arms such that said mounting arms are supported at a predetermined angle with respect to said inner portions of said pivot arms when said mounting arms are detached from said bucket, wherein said predetermined angle is substantially perpendicular;

wherein said outer portions of said pivot arms are oriented at an obtuse angle from said inner portions of said pivot arms.

17. The grapple of claim 16 wherein said grapple is balanced such that said mounting arms are positioned generally horizontally and spaced apart from a ground surface when outer portions of said pivot arms rest on said ground surface and inner portions of said pivot arms are oriented generally perpendicular to said mounting arms.

18. The grapple of claim 16 wherein said mounting arm has a triangular flange for positioning against said bucket adjacent to an opening of the bucket when the mounting arm is mounted to the bucket, said mounting arm has a first end for positioning adjacent to the bucket and a pivot coupling to said pivot arm adjacent to a second end of the mounting arm, said mounting arm having a first length between said first end of the mounting arm and a triangular flange, said mounting arm having a second length between said triangular flange and said pivot coupling, said second length being approximately equal to said first length for increasing the extent of the pivot arm from said triangular flange and increasing the grapple capacity of said toothed portion.

19. The grapple of claim 16 wherein said mounting arm has a triangular flange for positioning against said bucket adjacent to an opening of the bucket when the mounting arm is mounted to the bucket, said mounting arm has a first end for positioning adjacent to the bucket and a pivot coupling to said pivot arm adjacent to a second end of the mounting arm, said mounting arm having a first length between said first end of the mounting arm and a triangular flange, said mounting arm having a second length between said triangular flange and said pivot coupling, said pivot arm having a third length between said pivot coupling and the bend in said pivot arm, wherein the second length of the mounting arm is approximately equal to the third length of said pivot arm for increasing the extent of the pivot arm from said triangular flange and increasing the grapple capacity of said toothed portion.

* * * * *